US007396080B2

(12) United States Patent
Suhr et al.

(10) Patent No.: US 7,396,080 B2
(45) Date of Patent: Jul. 8, 2008

(54) CHAIR WITH TILT MECHANISM

(75) Inventors: Hans-Peter Suhr, Oberstenfeld (DE); Reinhard Weber, Minden (DE); Uwe Krautheimer, Ludwigshafen (DE)

(73) Assignee: VS Vereinigte Spezialmobelfabriken GmbH & Co., Tauberbischofsheim (DE)

( * ) Notice: Subject to any disclaimer, the term of this patent is extended or adjusted under 35 U.S.C. 154(b) by 151 days.

(21) Appl. No.: 11/054,328

(22) Filed: Feb. 8, 2005

(65) Prior Publication Data

US 2005/0218707 A1 Oct. 6, 2005

(30) Foreign Application Priority Data

Apr. 5, 2004 (DE) ..... 20 2004 005 366 U

(51) Int. Cl.
*A47C 1/00* (2006.01)

(52) U.S. Cl. ..... 297/313; 297/325; 297/326; 297/327

(58) Field of Classification Search ..... 297/313, 297/314, 325, 326, 327, 344.1
See application file for complete search history.

(56) References Cited

U.S. PATENT DOCUMENTS 4,131,260 A * 12/1978 Ambasz ..... 248/599
5,035,466 A * 7/1991 Mathews et al. ..... 297/337
5,409,295 A * 4/1995 Edstrom ..... 297/314
5,588,704 A * 12/1996 Harza ..... 297/314
5,649,740 A * 7/1997 Hodgdon ..... 297/303.1
6,059,363 A * 5/2000 Roslund et al. ..... 297/353
6,357,827 B1 * 3/2002 Brightbill et al. ..... 297/312
2002/0043846 A1 4/2002 Brauning

FOREIGN PATENT DOCUMENTS

| | | |
|---|---|---|
| DE | 29905547 | 9/2000 |
| DE | 10106791 | 8/2002 |
| EP | 0 920 823 | 6/1999 |

* cited by examiner

*Primary Examiner*—David Dunn
*Assistant Examiner*—Erika Garrett
(74) *Attorney, Agent, or Firm*—Occhiuti Rohlicek & Tsao LLP

(57) ABSTRACT

The invention describes a chair comprising a base structure, a seat having a seat surface and a backrest, a seat carrier for carrying the seat on the base structure, and a tilt mechanism which is arranged between the seat carrier and the base structure and which to improve the ergonomic properties of the chair is of such an arrangement and configuration that it permits inclination of the seat surface of the seat with respect to the horizontal both in a forward/rearward direction of the seat surface and also in a right/left direction of the seat surface. The tilt mechanism includes a pressure plate with a first conicity in the forward/rearward direction of the seat surface, by way of which the seat can be inclined in the forward/rearward direction, and a second conicity in the right/left direction of the seat surface, by way of which the seat can be inclined in the right/left direction.

14 Claims, 4 Drawing Sheets

CHAIR WITH TILT MECHANISM

BACKGROUND OF THE INVENTION

1. Field of the Invention

The present invention concerns a chair, in particular an office chair or a school chair, with a tilt mechanism for inclining the seat surface of the seat with respect to the horizontal both in a forward/rearward direction of the seat surface and also in a right/left direction of the seat surface.

2. Technical Background

FIG. 1 is a diagrammatic side view showing a conventional chair 10 in which the present invention can also be used. The chair 10 substantially comprises a base structure 12 and a seat 14. The seat 14 usually comprises a seat surface 16 and a backrest 18, wherein the seat surface 16 and the backrest 18 can either be integral or separate from each other. The base structure 12 comprises in known manner a star-shaped base 20 which is supported movably or stationarily on base rollers or support feet 22, and a chair pillar 24 with integrated gas spring.

The seat surface 16 of the seat 14 is carried on a seat carrier 26 which is supported resiliently and adjustably in respect of height on the gas spring of the chair pillar 24 by way of a mounting means 28. Arranged between the seat carrier 26 and the mounting means 28 for the gas spring of the chair pillar 24 is a tilt mechanism 30, by means of which the chair 14 can be inclined in the forward/rearward direction of the seat surface 16.

FIG. 2 shows a view in greater detail illustrating the structure of a conventional tilt mechanism 30 for a chair 10 as shown in FIG. 1. The tilt mechanism 30 comprises in particular a first housing portion 32 which is fixedly connected to the seat carrier 26 and a second housing portion 34 which is fixedly connected to the mounting means 28 for the gas spring of the chair pillar 24. Arranged between the first and second housing portions 32, 34 are a pressure plate 36 and two spring blocks 38 of an elastically deformable material. At its top side (or optionally its underside) the pressure plate 36 has an approximately hemispherical conicity in the forward/rearward direction of the seat surface 16 about a pivot axis 36*a*, and the spring blocks 38 are also arranged in the forward/rearward direction of the seat surface 16, with respect to the pressure plate 36.

The seat 14 of the chair 10 can be inclined in the forward/rearward direction of the seat surface 16 by means of that conventional tilt mechanism 30, by virtue of the fact that the first housing portion 32 which is fixedly connected to the seat 14 by way of the seat carrier 26 is tilted about the pivot axis 36*a* by way of the conicity of the pressure plate 36, in which case, depending on the respective direction of tilt movement of the seat 14, the forward or the rearward spring block 38 is compressed by the first housing portion 32 against the rigidly arranged second housing portion 34. In that case the seat 14 is mounted resiliently by the spring blocks 38 comprising the elastically deformable material. Depending on the respective nature and purpose of use of the chair 10, it is possible to use special materials with respectively adapted characteristic curves for the spring blocks 38.

In addition DE-A-101 06 791 discloses a chair on which the classifying portion of claim 1 is based. That known chair has a tilt mechanism which permits inclination of the seat surface with respect to the horizontal both in the usual forward/rearward direction of the seat surface and also additionally in the right/left direction of the seat surface. In that case the tilt mechanism comprises a triangular-shaped pivotal mounting for the seat surface by way of spring elements to a support frame. Overall in that way the seat surface can be tilted in directions which differ by about 45° from the seat direction.

SUMMARY OF THE INVENTION

Based on the above-described state of the art, the object of the present invention is to provide a chair having a tilt mechanism which, while being of a simple structure, enjoys improved ergonomic properties.

That object is attained by a chair comprising a base structure, a seat having a seat surface and a backrest, a seat carrier for carrying the seat on the base structure and a tilt mechanism which is arranged between the seat carrier and the base structure. The tilt mechanism is of such an arrangement and configuration that it permits inclination of the seat surface of the seat with respect to the horizontal both in a forward/rearward direction of the seat surface and also in a right/left direction of the seat surface. In accordance with the invention the tilt mechanism has a pressure plate with a first conicity in the forward/rearward direction of the seat surface, by way of which the seat can be inclined in the forward/rearward direction, and a second conicity in the right/left direction of the seat surface, by way of which the seat can be inclined in the right/left direction. In that case the two conicities of the pressure plate can be provided on mutually remote surface of the pressure plate in the up/down direction of the pressure plate. From ergonomic points of view, it is desirable for chairs, besides possible inclination of the seat surface in the forward/rearward direction, also to provide possible inclination of the seat surface in a right/left direction, and that is made possible in a simple manner in accordance with the invention by the particular tilt mechanism. The simple structure of the tilt mechanism according to the invention is also maintenance-friendly and enjoys a long service life.

For resiliently mounting the tilt mechanism preferably the pressure plate is mounted on elastically deformable first and second spring blocks, wherein at least one first spring block is associated with the pressure plate in the forward/rearward direction of the seat surface and at least one second spring block is associated with the pressure plate in the right/left direction of the seat surface.

In a further configuration of the invention the pressure plate is supported on the one hand against the seat carrier and on the other hand against a mounting member for the base structure or for the gas spring in a chair pillar of the base structure.

In still a further configuration of the invention the tilt mechanism has a first housing portion and a second housing portion, wherein the first housing portion is fixed to the seat carrier of the seat and the second housing portion is fixed to the first housing portion. Alternatively the first housing portion can also be fitted into the second housing portion and the second housing portion fixed to the seat carrier of the seat.

For ergonomic reasons the tilt mechanism should permit an inclination of the seat surface of the seat with respect to the horizontal in the forward/rearward direction of the seat surface by a maximum of between about 7.5° and about 8° and in the left/right direction of the seat surface by a maximum of about 3.5°.

The present invention can be used to particular advantage in relation to rotary chairs such as office chairs and school chairs.

BRIEF DESCRIPTION OF THE DRAWINGS

The foregoing and further features and advantages of the invention will be better appreciated from the description hereinafter of preferred, non-limiting embodiments by way of example with reference to the accompanying drawings in which.

DETAILED DESCRIPTION OF THE EMBODIMENTS PREFERRED AT THE PRESENT TIME

Figure 1:
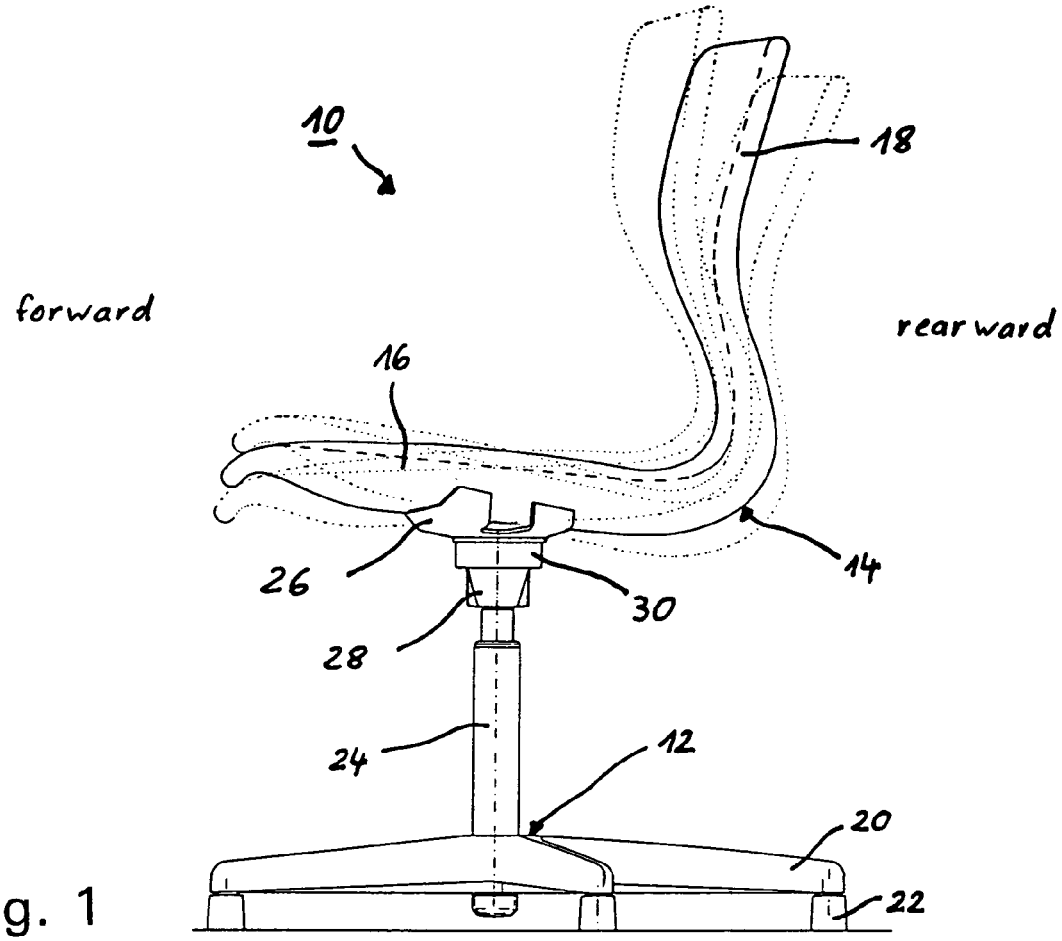
FIG. 1 is a diagrammatic side view of a chair with a tilt mechanism in which the present invention can be used.

The present invention can be used for example in relation to a rotary chair 10 in accordance with the above-described view in FIG. 1 without being limited to that use.

Figure 2:
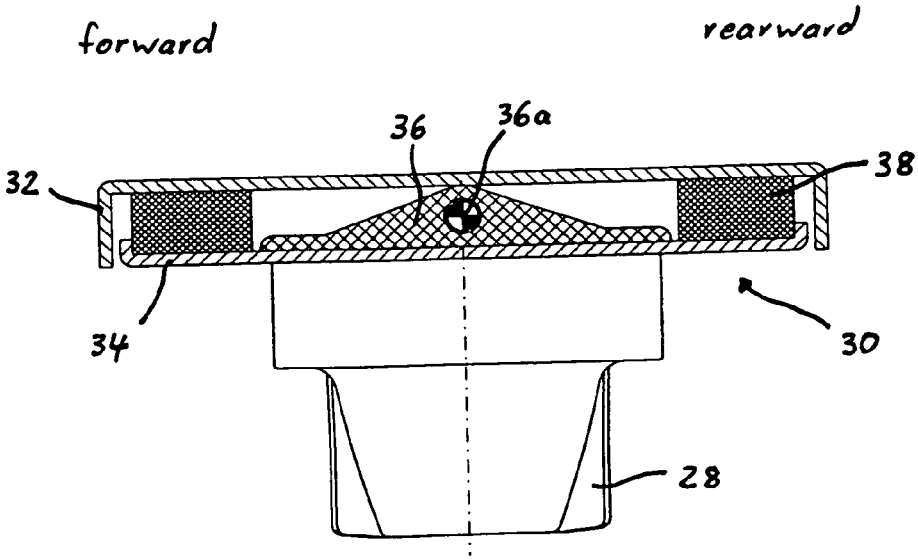
Fig. 2 Prior art
FIG. 2 is a diagrammatic view in section of a conventional tilt mechanism for a chair shown in FIG. 1.

A first embodiment of a tilt mechanism 30 will firstly be described in greater detail with reference to FIGS. 3 and 4. In that respect for the sake of simplicity the same reference numerals as in FIGS. 1 and 2 have been used for the same or corresponding components.

The tilt mechanism 30 has a first housing portion 32 and a second housing portion 34 of a pressure-resistant material such as for example metal, between which the other components of the tilt mechanism 30 are accommodated. In the first embodiment in this case the first housing portion 32 is fitted into the second housing portion 34 and the second housing portion 34 can be fixedly connected to the seat carrier 26 of the seat 14 of a chair 10 for example by means of screw connections.

Arranged between the two housing portions 32 and 34 of the tilt mechanism 30 are two first spring blocks 38 and two second spring blocks 42, a mounting member 40 and a pressure plate 36.

The first and second spring blocks 38, 42 are accommodated in pairs in the forward/rearward direction and the right/left direction respectively of the seat surface 16 in corresponding recesses 34*a*, 34*b* of the second housing portion 34. The first and second spring blocks 38, 42 comprise an elastically deformable material such as for example a (cellular) polyurethane elastomer and serve for sprung mounting of the tilt mechanism 30. Polyurethane elastomer can be obtained in various densities and with different spring characteristics which are generally greatly progressive. The spring blocks 38, 42 can therefore be selected in optimally adapted fashion depending on the respective nature and purpose of use of the chair 10 and the desired maximum inclination of the seat 14. In particular the first spring blocks 38 can also be provided with different properties from the second spring blocks 42. In that case, to simplify assembly of the tilt mechanism 30, the first and second spring blocks 38, 42 can be identified by being of different colors. It will be appreciated however that the present invention is not restricted just to spring blocks 38, 42 of a polyurethane elastomer.

The mounting member 40 comprising a pressure-resistant material such as for example metal or plastic material with incorporated metal components is fitted on to the spring blocks 38, 42. The mounting member 40 has a plate portion 40*a* and a central tubular portion 40*b* which are preferably integral. With the peripherally extending plate portion 40*a*, the mounting member 40 is supported on the spring blocks 38, 42 while the tubular portion 40*b* serves to receive the chair pillar 24 or the gas spring in the chair pillar 24, which projects through a corresponding opening 34*c* (not shown in FIG. 3) in the bottom of the second housing portion 34.

The pressure plate 36 comprising a pressure-resistant material such as for example metal or plastic material with incorporated metal components is fitted on to the mounting member 40. The pressure plate 36 centrally has an opening 36*d* through which the upper part of the tubular portion 40*b* of the mounting member 40 is passed. The pressure plate 36 is supported on the plate portion 40*a* of the mounting member 40.

Figure 3:
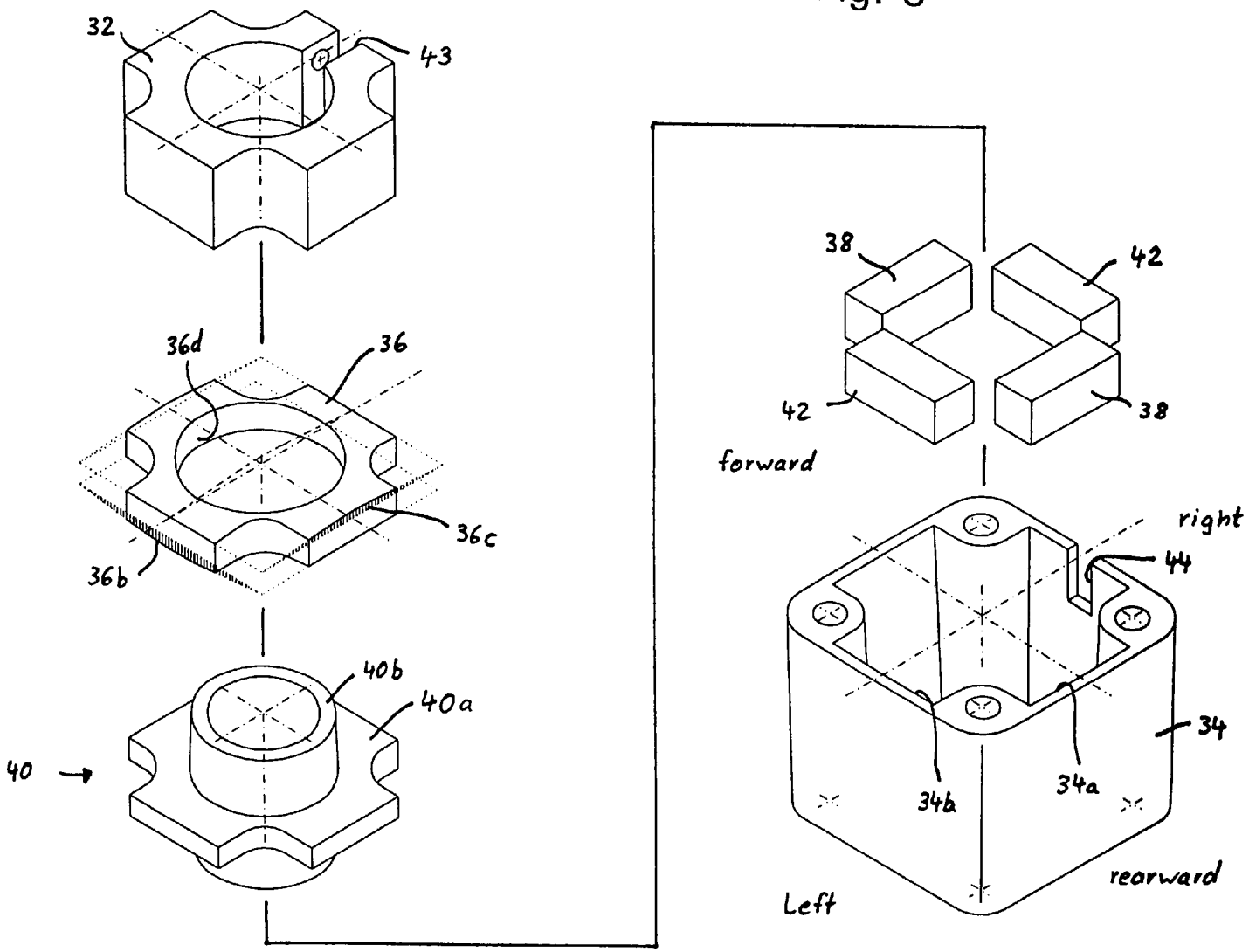
FIG. 3 is an exploded perspective view of the components of a tilt mechanism in accordance with a first embodiment of the present invention.

As indicated in FIG. 3 and as can be better seen from FIG. 4 the pressure plate 36 has a first conicity 36*b* and a second conicity 36*c*. The first conicity 36*b* is provided on the underside of the pressure plate 36 and extends in the forward/rearward direction of the seat surface 16 while the second conicity 36*c* is provided on the top side of the pressure plate 36 and extends in the right/left direction of the seat surface 16, that is to say turned through 90° with respect to the first conicity 36*b*. As described in greater detail hereinafter with reference to FIG. 4 the first conicity 36*b* serves for possible inclination of the seat 14 in the forward/rearward direction of the seat surface 16 and the second conicity 36*c* serves for possible inclination of the seat 14 in the right/left direction of the seat surface 16.

The first housing portion 32 is fitted on to the pressure plate 36, the first housing portion 32 being fitted like the other components of the tilt mechanism 30 into the second housing portion 34. When the tilt mechanism 30 has been assembled and fixed to the seat carrier 26 of the seat 14 the first and second spring blocks 38, 42 are correspondingly biased.

As shown in FIG. 3 the first and second housing portions 32 and 34 also each have a respective cut-out 43 and 44 for a gas spring lever 46, with which the gas spring in the chair pillar 26 can be actuated in known manner and the height of the seat 14 above the base structure 12 can be adjusted.

Figure 4A:
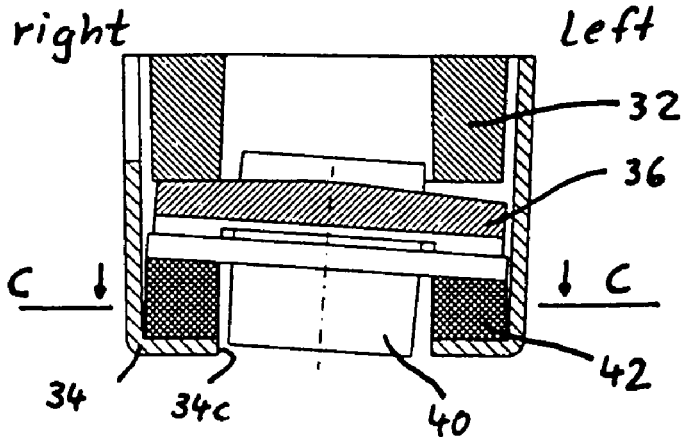
FIG. 4*a* shows a diagrammatic view in section of the tilt mechanism of FIG. 3 along section line A-A in FIG. 4*c* to describe inclination in the right/left direction of the seat surface.
Figure 4B:
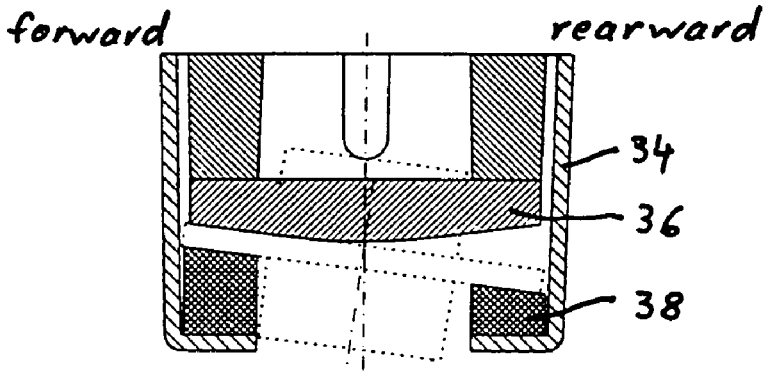
FIG. 4*b* shows a diagrammatic view in section of the tilt mechanism of FIG. 3 along section line B-B in FIG. 4*c* to describe inclination in the forward/rearward direction of the seat surface.
Figure 4C:
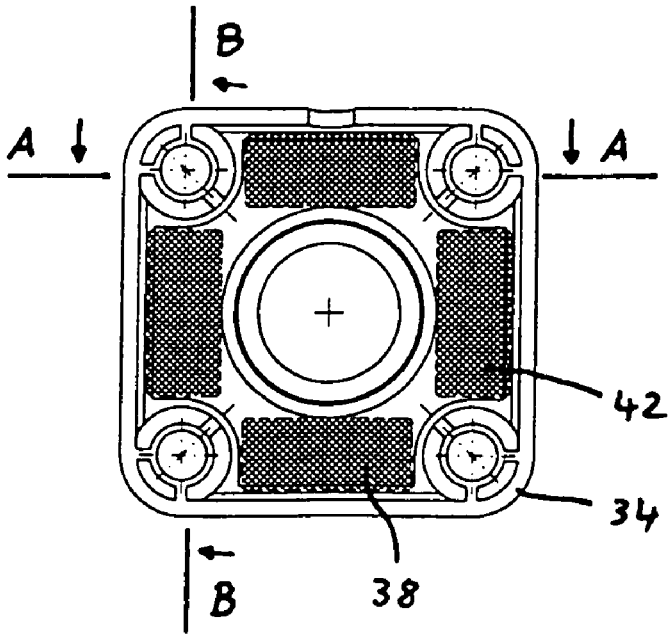
FIG. 4*c* is a diagrammatic view in section of the tilt mechanism of FIG. 3 taken along line C-C in FIG. 4*a*.
Figure 5C:
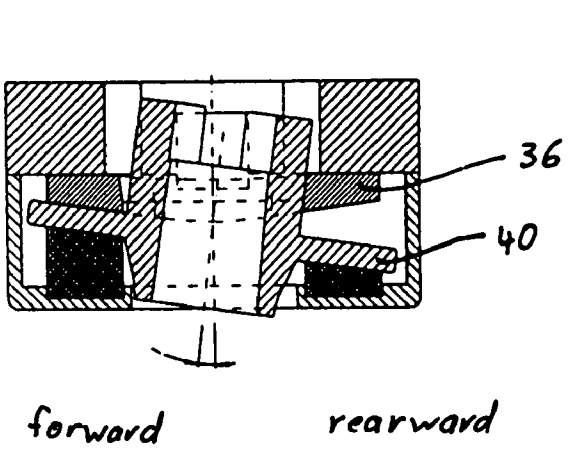
FIG. 5*c* is a diagrammatic view in section of a tilt mechanism according to the second embodiment of the invention similarly to the view in FIG. 4*b* in an inclined position.
Figure 5D:
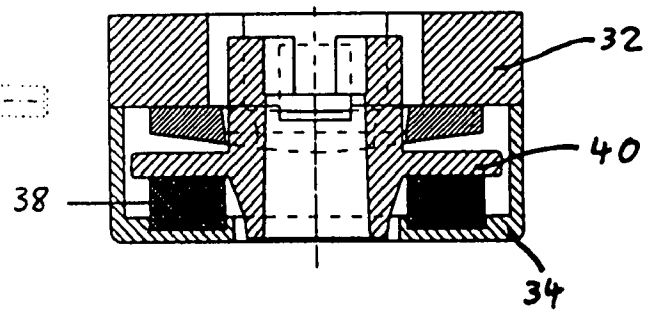
FIG. 5*d* is a diagrammatic view in section of a tilt mechanism according to the second embodiment of the invention similarly to the view in FIG. 4*b* in the rest position.
Figure 5A:
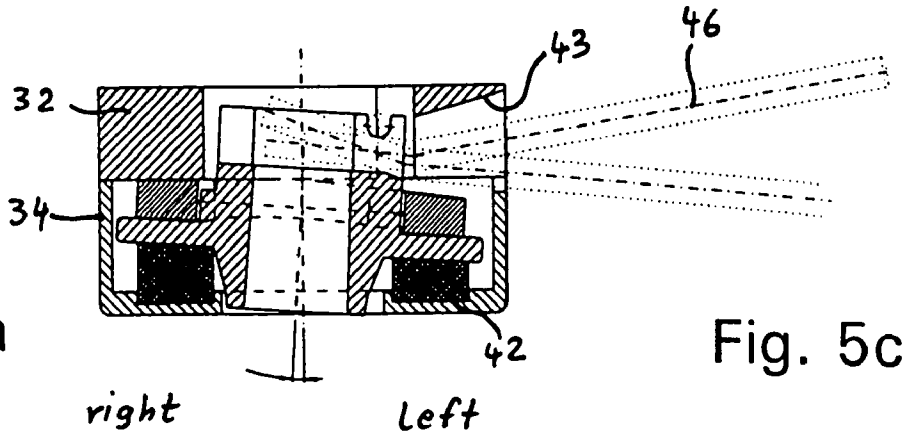
FIG. 5*a* is a diagrammatic view in section of a tilt mechanism according to a second embodiment of the invention similarly to the view in FIG. 4*a* in an inclined position.
Figure 5B:
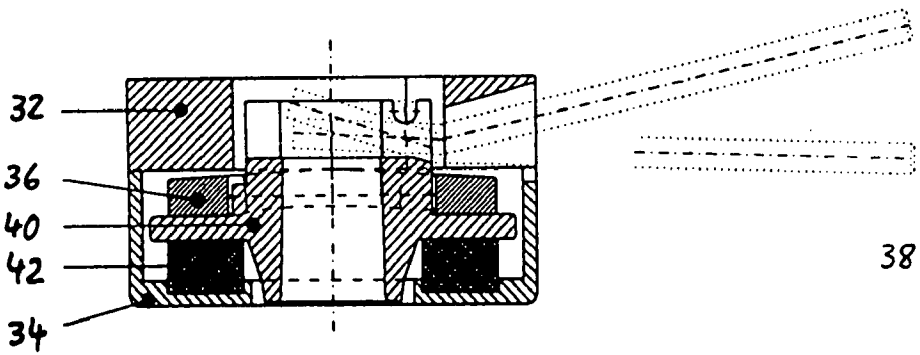
FIG. 5*b* is a diagrammatic view in section of a tilt mechanism according to the second embodiment of the invention similarly to the view in FIG. 4*a* in a rest position.

FIGS. 4*a*, 4*b* and 4*c* show various sectional views of the assembled tilt mechanism 30 of FIG. 3 in order to show in greater detail the mode of operation of the tilt mechanism 30 according to the invention.

The view in FIG. 4*a* shows how the seat 14 can be inclined in the right/left direction of the seat surface 16 with respect to the horizontal. In FIG. 4*a* the seat 14 is inclined towards the left by about 3.5° whereby the first housing portion 32 and the second housing portion 34 connected thereto are also tilted. The mounting member 40 is fixedly connected to the chair pillar 24 and thus remains oriented vertically. The inclination of the seat 14 in the right/left direction of the seat surface 16 is limited by the top side of the second conicity 36*c* of the pressure plate 36 bearing against the underside of the first housing portion 32, in which case in this arrangement the second spring block 42 which is remote from the condition of mutual abutting contact is compressed against its inherent spring force.

In a similar manner the seat 14 can be inclined forwardly or rearward by up to about between 7.5° and 8°, as shown in FIG. 4*b*, whereby the first housing portion 32 and the second housing portion 34 connected thereto are also tilted. The mounting member 40 again remains fixedly oriented vertically. The inclination of the seat 14 in the forward/rearward direction of the seat surface 16 is restricted by the underside of the first conicity 36*b* of the pressure plate 36 butting against the top side of the plate portion 40*a* of the mounting member 40 and by the top side of the non-conical pressure plate 36 butting against the underside of the first housing portion 32, wherein in this arrangement the first spring block 38 which is remote from the mutually butting components is compressed against its inherent spring force.

The friction between the spring blocks 38, 42, the mounting member 40 and the housing portions 32, 34 is sufficiently great that the mounting member 40 can remain securely and permanently fixed in its position so that the individual components are not displaced relative to each other and as a result do not give rise to noise and/or suffer from wear.

A second embodiment of a tilt mechanism according to the invention will be described hereinafter with reference to FIGS. 5*a* through 5*d*. In this case identical or similar components are denoted by the same references as in FIGS. 1 through 4 and a repeated description of the structure and mode of operation thereof is substantially renounced here.

The tilt mechanism 30 of the second embodiment of FIG. 5 differs from the tilt mechanism of the first embodiment in particular in the two housing portions 32 and 34. While, in the above-described first embodiment, the first housing portion 32 is fitted into the second housing portion 34 and the second housing portion 34 is fixedly connected to the seat carrier 26 of the seat 14 of a chair 10 for example by means of screw connections, the embodiment of FIG. 5 provides that the first housing portion 32 is fixedly connected to the seat carrier 26 of the seat 14 for example by means of screw connections and the second housing portion 34 is fixedly connected to the first housing portion 32 for example by means of screw connections.

That structure of the first and second housing portions 32, 34 has the advantage that the first housing portion 32 can be used so-to-speak as an adaptor for adaptation to the pattern of holes of the respective seat carrier 26.

The other components (spring blocks 38 and 42, mounting member 40 and pressure plate 36) correspond to those of the foregoing embodiment and the same modes of operation and advantages can be achieved with the tilt mechanism 30 of FIG. 5, as with the above-described tilt mechanism.

The tilt mechanism 30 according to the invention, besides the known inclination of a seat 14 in the forward/rearward direction of the seat surface, also permits inclination of the seat 14 in the right/left direction of the seat surface 16, which is advantageous for ergonomic reasons. Integration according to the invention of the two inclination options in the forward/rearward direction of the seat surface 16 and in the right/left direction of the seat surface 16 in a common tilt mechanism 30 also effectively avoids an unwanted increase in the height of the seat 14.

The maximum inclinations specified in the present description of about 3.5° for the right/left direction of the seat surface 16 and about between 7.5° and 8° for the forward/rearward direction of the seat surface 16 have been found to be particularly appropriate from ergonomic points of view. It will be appreciated however that the present invention is not limited to those maximum values but rather it is also possible to select smaller or larger maximum inclinations, if desired.

The invention claimed is:

1. A chair comprising a base structure;

a seat having a seat surface and a backrest;

a seat carrier for carrying the seat on the base structure; and a tilt mechanism which is arranged between the seat carrier and the base structure and which is of such an arrangement and configuration that it permits inclination of the seat surface of the seat with respect to the horizontal both in a forward/rearward direction of the seat surface and also in a right/left direction of the seat surface, characterized in that the tilt mechanism has a pressure plate with a first conicity in the forward/rearward direction of the seat surface, by way of which the seat can be inclined in the forward/rearward direction, and a second conicity in the right/left direction of the seat surface, by way of which the seat can be inclined in the right/left direction, wherein the pressure plate is mounted on elastically deformable first and second spring blocks, wherein at least one first spring block is associated with the pressure plate in the forward/rearward direction of the seat surface and at least one second spring block is associated with the pressure plate in the right/left direction of the seat surface.

2. A chair as set forth in claim 1 wherein the pressure plate is supported on the one hand against the seat carrier and on the other hand against a mounting member for the base structure.

3. A chair as set forth in claim 1 wherein the tilt mechanism has a first housing portion and a second housing portion, wherein the first housing portion is fixed to the seat carrier of the seat and the second housing portion is fixed to the first housing portion.

4. A chair as set forth in claim 1 wherein the tilt mechanism permits an inclination of the seat surface of the seat with respect to the horizontal in the forward/rearward direction of the seat surface by a maximum of about 8°.

5. A chair as set forth in claim 1 wherein the tilt mechanism permits an inclination of the seat surface of the seat with respect to the horizontal in the right/left direction of the seat surface by a maximum of about 3.5°.

6. A chair as set forth in claim 1 which is in the form of a rotary chair.

7. A chair as set forth in claim 1 wherein the pressure plate has a first inclined surface corresponding to the first conicity and a second inclined surface corresponding to the second conicity.

8. A chair comprising a base structure;

a seat having a seat surface and a backrest;

a seat carrier for carrying the seat on the base structure; and a tilt mechanism which is arranged between the seat carrier and the base structure and which is of such an arrangement and configuration that it permits inclination of the seat surface of the seat with respect to the horizontal both in a forward/rearward direction of the seat surface and also in a right/left direction of the seat surface, characterized in that the tilt mechanism has a pressure plate with a first conicity in the forward/rearward direction of the seat surface, by way of which the seat can be inclined in the forward/rearward direction, and a second conicity in the right/left direction of the seat surface, by way of which the seat can be inclined in the right/left direction, wherein the pressure plate is mounted on elastically deformable first and second spring blocks, wherein at least one first spring block is associated with the pressure plate in the forward/rearward direction of the seat surface and at least one second spring block is associated with the pressure plate in the right/left direction of the seat surface, wherein the first and second conicities of the pressure plate are provided on mutually remote surfaces of the pressure plate in the up/down direction of the pressure plate.

9. A chair as set forth in claim 8 wherein the pressure plate is supported on the one hand against the seat carrier and on the other hand against a mounting member for the base structure.

10. A chair as set forth in claim 8 wherein the tilt mechanism has a first housing portion and a second housing portion, wherein the first housing portion is fixed to the seat carrier of the seat and the second housing portion is fixed to the first housing portion.

11. A chair as set forth in claim 8 wherein the tilt mechanism permits an inclination of the seat surface of the seat with respect to the horizontal in the forward/rearward direction of the seat surface by a maximum of about 8°.

12. A chair as set forth in claim 8 wherein the tilt mechanism permits an inclination of the seat surface of the seat with respect to the horizontal in the right/left direction of the seat surface by a maximum of about 3.5°.

13. A chair as set forth in claim 8 which is in the form of a rotary chair.

14. A chair as set forth in claim 8 wherein the pressure plate has a first inclined surface corresponding to the first conicity and a second inclined surface corresponding to the second conicity.

* * * * *